US007722311B2

(12) United States Patent
Peterson et al.

(10) Patent No.: US 7,722,311 B2
(45) Date of Patent: May 25, 2010

(54) PRESSURE AND CURRENT REDUCING IMPELLER

(75) Inventors: Todd R. Peterson, New Boston, MI (US); Ketan Adhvaryu, Sterling Heights, MI (US); Ramon B. Jaramillo, Sterling Heights, MI (US)

(73) Assignee: BorgWarner Inc., Auburn Hills, MI (US)

( * ) Notice: Subject to any disclaimer, the term of this patent is extended or adjusted under 35 U.S.C. 154(b) by 734 days.

(21) Appl. No.: 11/606,669

(22) Filed: Nov. 30, 2006

(65) Prior Publication Data

US 2007/0160456 A1 Jul. 12, 2007

Related U.S. Application Data

(63) Continuation-in-part of application No. 11/330,271, filed on Jan. 11, 2006, now Pat. No. 7,425,113.

(51) Int. Cl.
*F04D 5/00* (2006.01)

(52) U.S. Cl. ..... 415/55.1; 415/55.2; 415/55.4; 415/55.7; 415/119

(58) Field of Classification Search ..... 415/55.1, 415/55.2, 55.4, 55.7, 119
See application file for complete search history.

(56) References Cited

U.S. PATENT DOCUMENTS

| | | | | | |
|---|---|---|---|---|---|
| 2,217,211 | A | * | 10/1940 | Brady | 415/55.4 |
| 2,282,569 | A | * | 5/1942 | Fabig | 415/203 |
| 3,359,908 | A | | 12/1967 | Toma | |
| 3,951,567 | A | * | 4/1976 | Rohs | 415/119 |
| 4,065,231 | A | | 12/1977 | Litzenberg | |
| 4,586,877 | A | * | 5/1986 | Watanabe et al. | 417/365 |
| 5,391,062 | A | * | 2/1995 | Yoshioka | 417/423.3 |
| 5,395,210 | A | | 3/1995 | Yamazaki et al. | |
| 5,407,318 | A | | 4/1995 | Ito et al. | |
| 5,449,269 | A | * | 9/1995 | Frank et al. | 415/55.1 |
| 5,762,469 | A | * | 6/1998 | Yu | 415/55.1 |
| 6,017,183 | A | * | 1/2000 | Dobler et al. | 415/55.1 |
| 6,056,506 | A | | 5/2000 | Martin et al. | |
| 6,422,808 | B1 | * | 7/2002 | Moss et al. | 415/55.1 |
| 6,454,520 | B1 | | 9/2002 | Pickelman et al. | |
| 6,688,844 | B2 | | 2/2004 | Yu | |
| 6,767,179 | B2 | | 7/2004 | Kusagaya et al. | |
| 6,779,968 | B1 | | 8/2004 | Rietschle et al. | |
| 6,890,144 | B2 | * | 5/2005 | Yu et al. | 415/55.4 |

FOREIGN PATENT DOCUMENTS

| | | |
|---|---|---|
| EP | 0 787 903 A2 | 8/1997 |
| EP | 1 452 738 A2 | 9/2004 |
| JP | 58-211595 | 12/1983 |
| JP | 59-211599 | 11/1984 |
| JP | 11-218097 | 8/1999 |

* cited by examiner

*Primary Examiner*—Igor Kershteyn
(74) *Attorney, Agent, or Firm*—Warn Partners, P.C.

(57) ABSTRACT

A pump having a housing with a torus and a stripper region. The stripper region has a housing groove formed on the surface of the stripper region. The housing groove has a surface forming a length, width and depth of the groove. The pump also has a cover connectable to the housing. The cover extends over the housing groove formed on the surface of the stripper region. An impeller has a plurality of vanes that extend radially outward from an impeller frame, wherein the impeller is rotatably positioned between the housing. The cover and the plurality of vanes are positioned in operable relation to said housing groove.

26 Claims, 7 Drawing Sheets

PRESSURE AND CURRENT REDUCING IMPELLER

CROSS-REFERENCE TO RELATED APPLICATIONS

This application is a continuation-in-part of U.S. patent application Ser. No. 11/330,271 filed on Jan. 11, 2006. The disclosure of the above application is incorporated herein by reference.

FIELD OF THE INVENTION

The present invention relates to a secondary air fan used in a motor vehicle.

BACKGROUND OF THE INVENTION

When an engine goes through a cold start condition a secondary air flow fan can be used to inject air into the engine's exhaust system. The reason the air is injected into the exhaust system is so that oxygen is present in the exhaust system and causes excess hydrocarbons to be combusted. This also helps the catalytic converter to perform efficiently or achieve optimal temperature in a shorter amount of time.

An impeller fan can be used to create the air movement in the secondary air flow system. One phenomena that can occur with secondary air flow systems is what is referred to as "dead head" condition. A dead head condition is when the air flow or output channel from the impeller becomes blocked. In other words, due to impeller design the pump will reach dead head at relatively high pressures and prevent the downstream valve from closing.

Furthermore, as the pressure increases the electrical current drawn by the motor increases. This is an undesirable condition because it is a drag on the vehicle electrical system. Therefore, it is desirable to develop an impeller that would reduce the pressure at the dead head condition, and thus reduce the amount of current drawn by the impeller.

SUMMARY OF THE INVENTION

The present invention is directed to a pump having a housing with a torus and a stripper region that is a region between an inlet and outlet of the pump. The stripper region has a housing groove formed on the surface of the stripper region. The housing groove has a surface forming a length and width of the groove. The housing groove has at least one tapered depth section on said surface of said housing groove. The pump also has a cover connectable to the housing and cover. The cover extends over the housing groove formed on the surface of the stripper region. An impeller has a plurality of vanes that extend radially outward from an impeller frame, wherein the impeller is rotatably positioned between the housing and cover. The cover and the plurality of vanes are positioned in operable relation to said housing groove.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

The present invention will become more fully understood from the detailed description and the accompanying drawings, wherein.

DETAILED DESCRIPTION OF THE PREFERRED EMBODIMENTS

Figure 1:
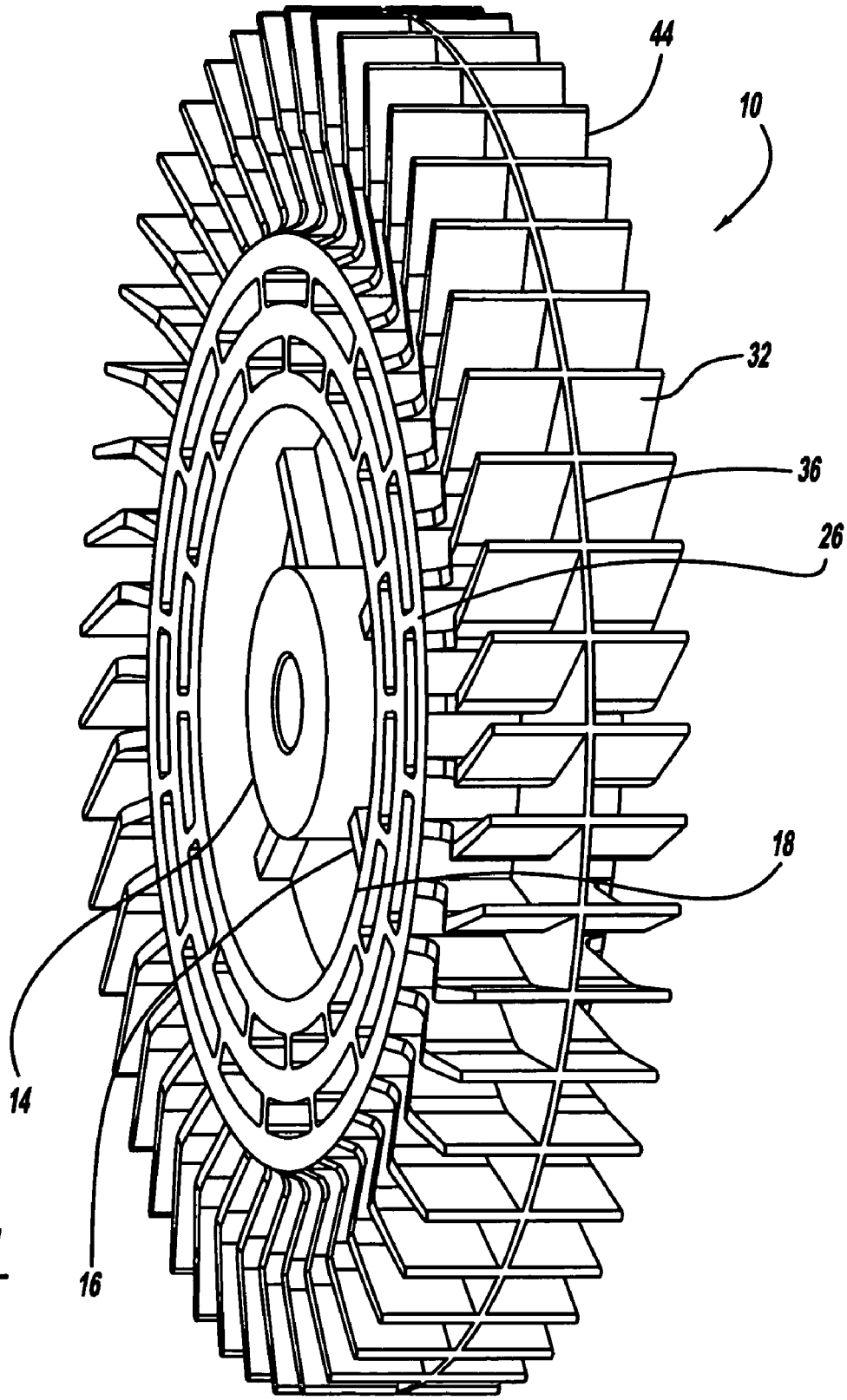
FIG. 1 is a perspective view of the impeller fan.

The following description of the preferred embodiment(s) is merely exemplary in nature and is in no way intended to limit the invention, its application, or uses.

Referring to FIGS. 1, 1*a*, 1*b*, and 2, an impeller fan is generally shown at 10 and the impeller 10 has a casing 12. The casing 12 has an inlet (not shown) and an outlet (not shown), in which the air flows in and out of the casing 12 respectfully. The center of the impeller 10 has an inner radial surface 14 that creates an axial bore where a shaft (not shown) can extend through the axial bore. The impeller fan 10 can then rotate. The impeller fan 10 has at least one radial support 16 that is spaced circumferentially around the inner radial surface 14, and extends radially to an outer radial surface 18. Therefore, the radial supports 16 connect the inner radial surface 14 with the outer radial surface 18.

Vanes 32 are spaced circumferentially around the impeller frame 26. The spacing of the vanes 32 around the outer radial surface 18 creates vane grooves 34 between each of the vanes 32. The vanes 32 have a base 35 that is connected to an impeller frame 26. The vanes 32 are angled at a point 40, such that neither an outer angled surface 42 nor the base 35 extend directly radially from the impeller frame 26. The vanes 32 have an inner angled surface 38 and the outer angled surface 42, which meet at the point 40, and the angle at which the vane 32 extends from the impeller frame 26 can be altered. Thus, the point 40 can be anywhere along the length of the vane 32.

Figure 1A:
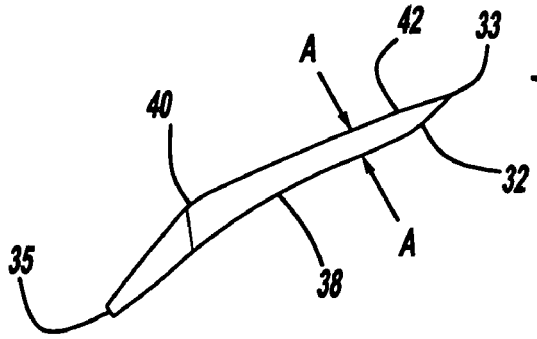
FIG. 1*a* is a top plan view of a vane with Line A-A depicting the thickness of the vane.

Furthermore, vanes 32 have a tapered thickness that is shown in FIG. 1*a*, which depicts a top view of a single vane 32 separated from the impeller 10. The thickness of the vane is shown at Line A-A in FIG. 1*a*. Thus, the vane 32 has a thickness that is greater at point 40 than the thickness of the vane 32 at the base 35 and at a vane tip 33. The thickness of the vane 32 can vary along its length or can be constant.

Figure 1B:
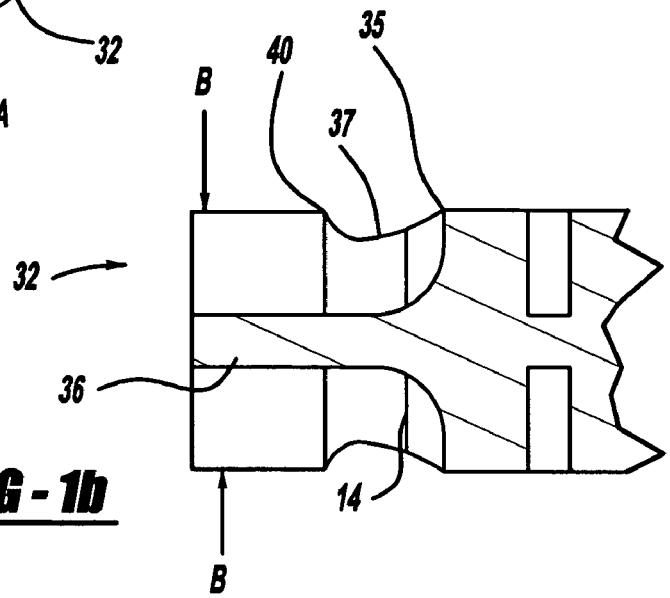
FIG. 1*b* is a side plan view of a single vane with Line B-B depicting the height of the vane.
Figure 2:
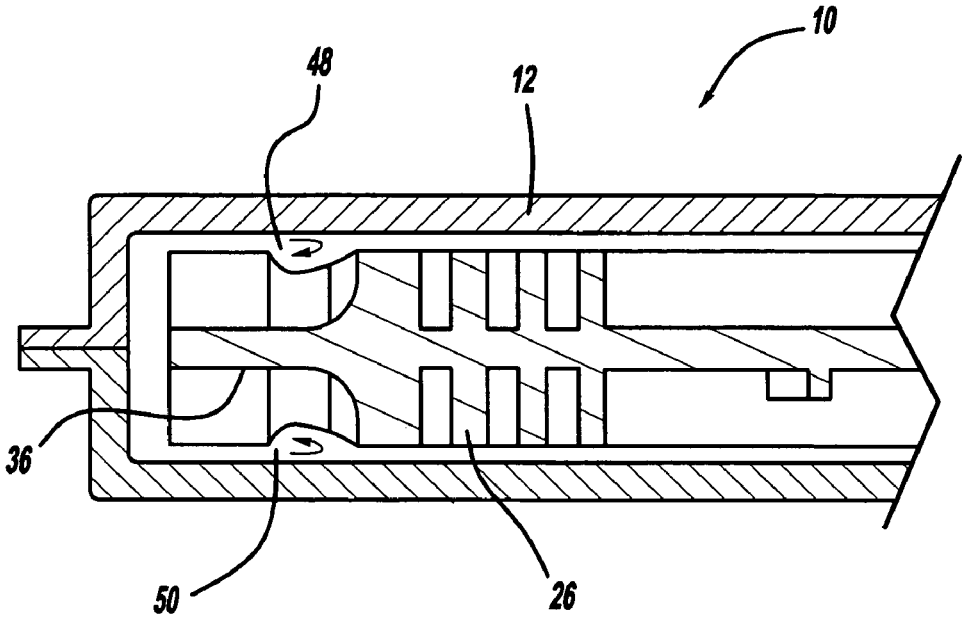
FIG. 2 is a cross-sectional view of the impeller fan.

FIGS. 1*b* and 2 depict a side view of an individual vane shown in FIGS. 1 and 1*a*. The height of the vane 32 is shown along Line B-B in FIG. 1*b*. Between the base 35 and the point 40 of each vane 32 there is a pressure relief feature 37. This pressure relief feature 37 is a curved recess of varying height in the vane 32 that will cause pressure relief as the vane moves within the casing 12. In particular the pressure relief feature 37 will relieve pressure between the inlet and outlet of the pump which reduces pressure at a deadhead condition. The divider 36 can be located at any position along the height of the vane 32. Additionally the divider 36 can extend radially anywhere from the base 35 to the tip 33 of the vane 32.

The pressure relief feature 37 in the height of the vanes 32 changes the flow characteristics of impeller fan 10, so that a dead head pressure is reduced when compared to the dead head pressure created by a standard impeller fan. The vanes 32 in combination with the pressure relief feature 37 all contribute to pressure relief provided by the impeller fan 10. If the divider 36 is used, it will create an upper flow area 48 and a lower flow area 50. The impeller fan 10 having vanes 32 in conjunction with the divider 36 increases the flow, whereas an impeller fan that has no divider 36 decreases the flow.

The pressure relief feature 37 of the vanes 32 and the divider 36 create a flow rate in the upper flow area 48 and a flow rate in the lower flow area 50. Both the upper flow area 48 and the lower flow area 50 have a pressure leakage between the inlet and outlet along the sealing area via the pressure relief feature 37. The leakage reduces the pressure in the upper flow area 48 and the lower flow area 50, which in turn reduces the dead head pressure. Thus, the reduction of the dead head pressure also reduces the amount of current drawn by the impeller fan 10.

Figure 4:
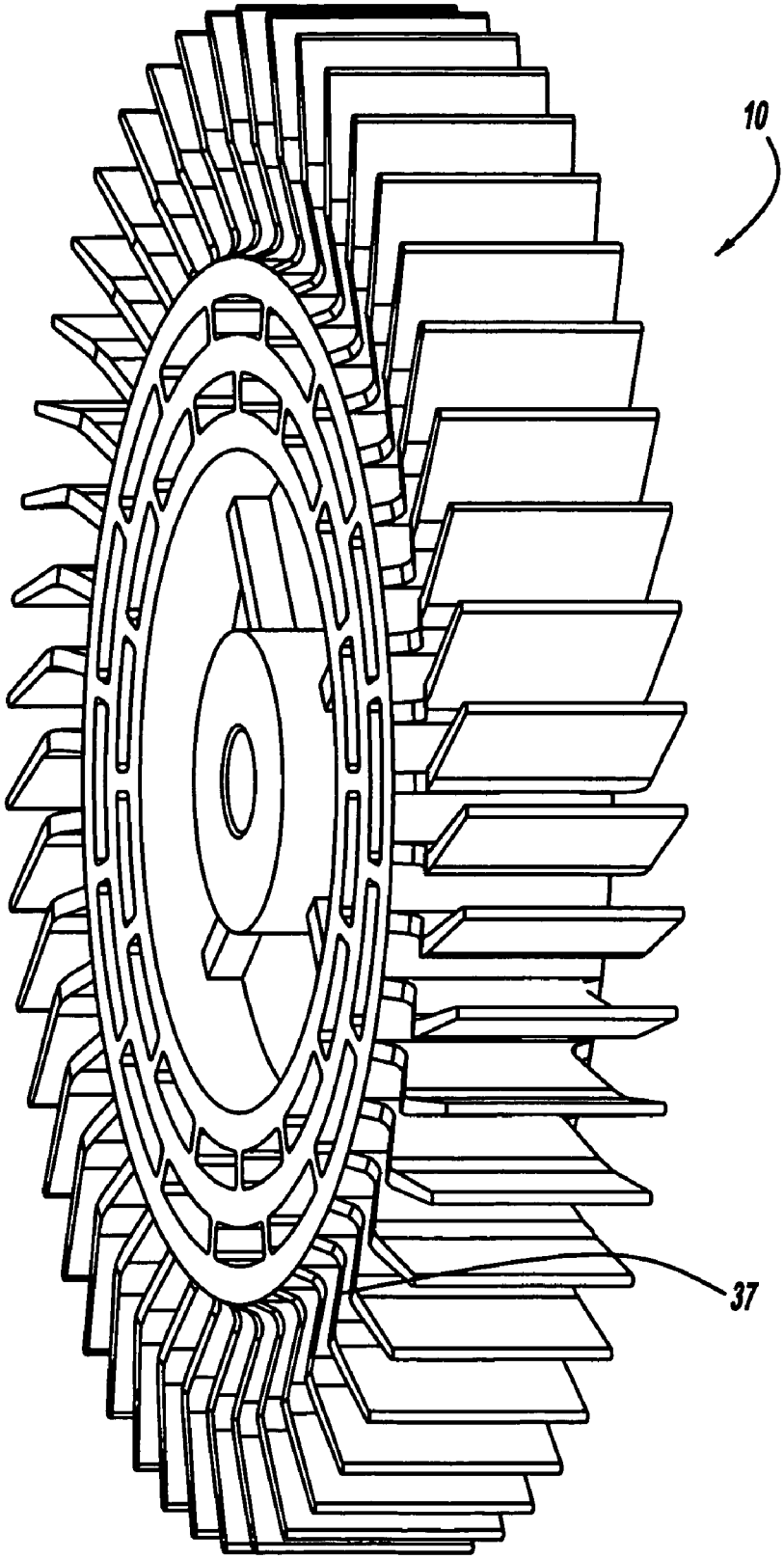
FIG. 4 is a perspective view of the impeller fan without a divider.

FIG. 4 depicts an embodiment where the impeller 10 has no divider extending between the vanes 32. However, the vanes 32 still have the pressure relief feature 37.

Figure 3:
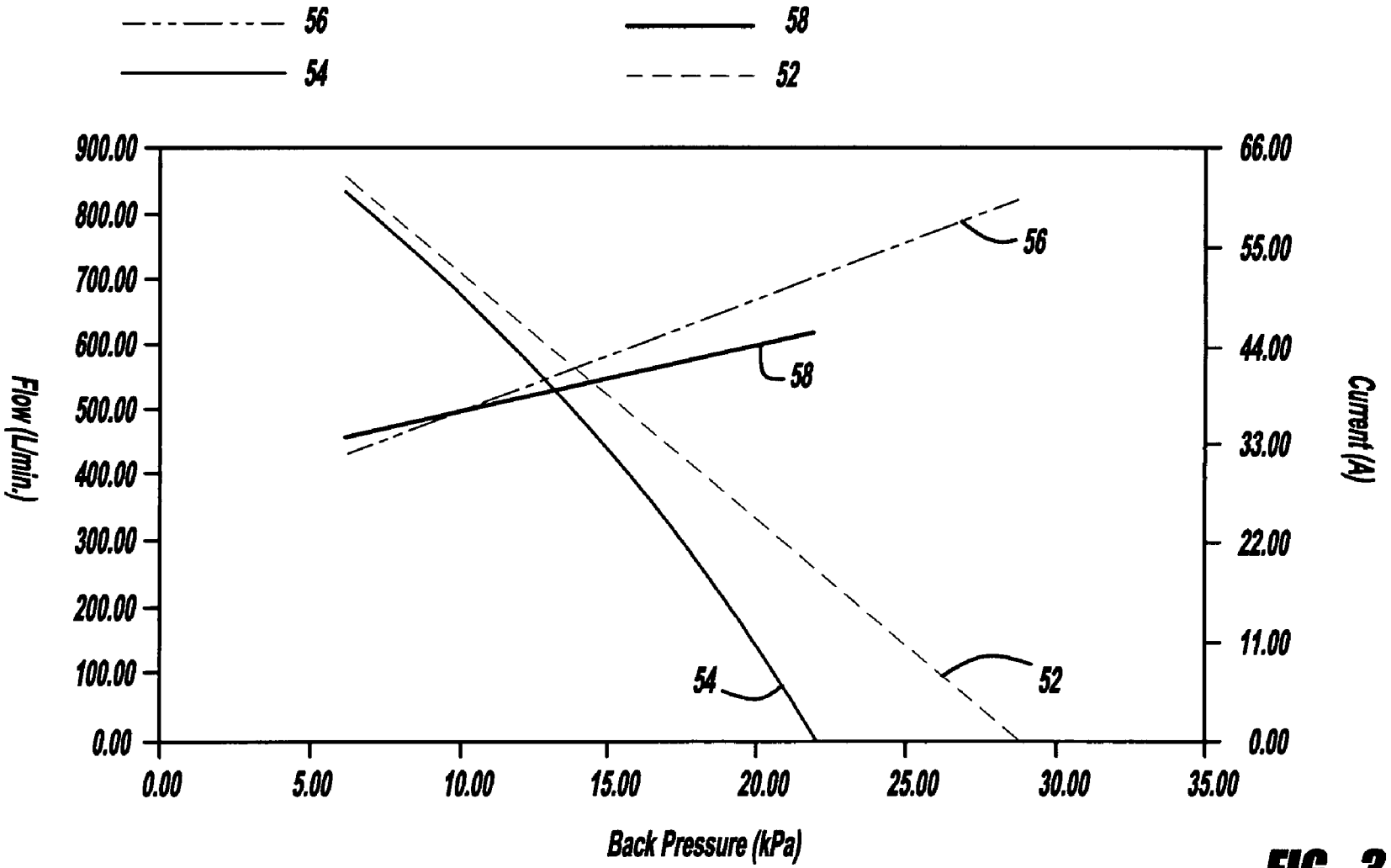
FIG. 3 is a line graph showing the flow, back pressure, and current characteristics of the secondary air pump.

Referring to FIG. 3, the flow, backpressure, and current characteristics are compared between a secondary air system using the impeller fan 10 and a standard impeller fan (one that does not have a vane design as the present invention). A line 52 depicts the flow and back pressure characteristics of the standard impeller fan. Line 56 shows that as the back pressure increases in the standard impeller fan the current continues to increase. Thus, the standard impeller fan causes the back pressure to increase to a final value that is to great for the secondary air system, and the back pressure is greater than 22 kPa when the flow is at 0.0 L/min. However, when the impeller fan 10 is used in the secondary air system the back pressure does not reach a maximum back pressure that is as high as that of a standard impeller fan, as shown by line 54. Therefore, when the flow is at 0.0 L/min the back pressure is approximately 22 kPa, which is lower than the standard dead head condition. Thus, the dead head pressure of the impeller fan 10 is approximately 20% less than a standard impeller. Likewise, the current draw of the impeller fan 10 is approximately 25% lower at the dead head condition, than a standard impeller fan at a dead head condition. Moreover, line 56 shows the amount of electrical current drawn by the standard impeller fan from the vehicle electrical system (not shown) as the back pressure increases. If a dead head condition is desired in the secondary air system, the system may not function properly if the back pressure is over 25 kPa. These high back pressures result in high current drain in excess of 60 A. However, impeller fan 10 not only results in max back pressure less than 25 kpa but also does not draw as much current as the standard fan. Thus, the impeller fan 10 puts less strain on the vehicle electrical system.

Figure 5A:
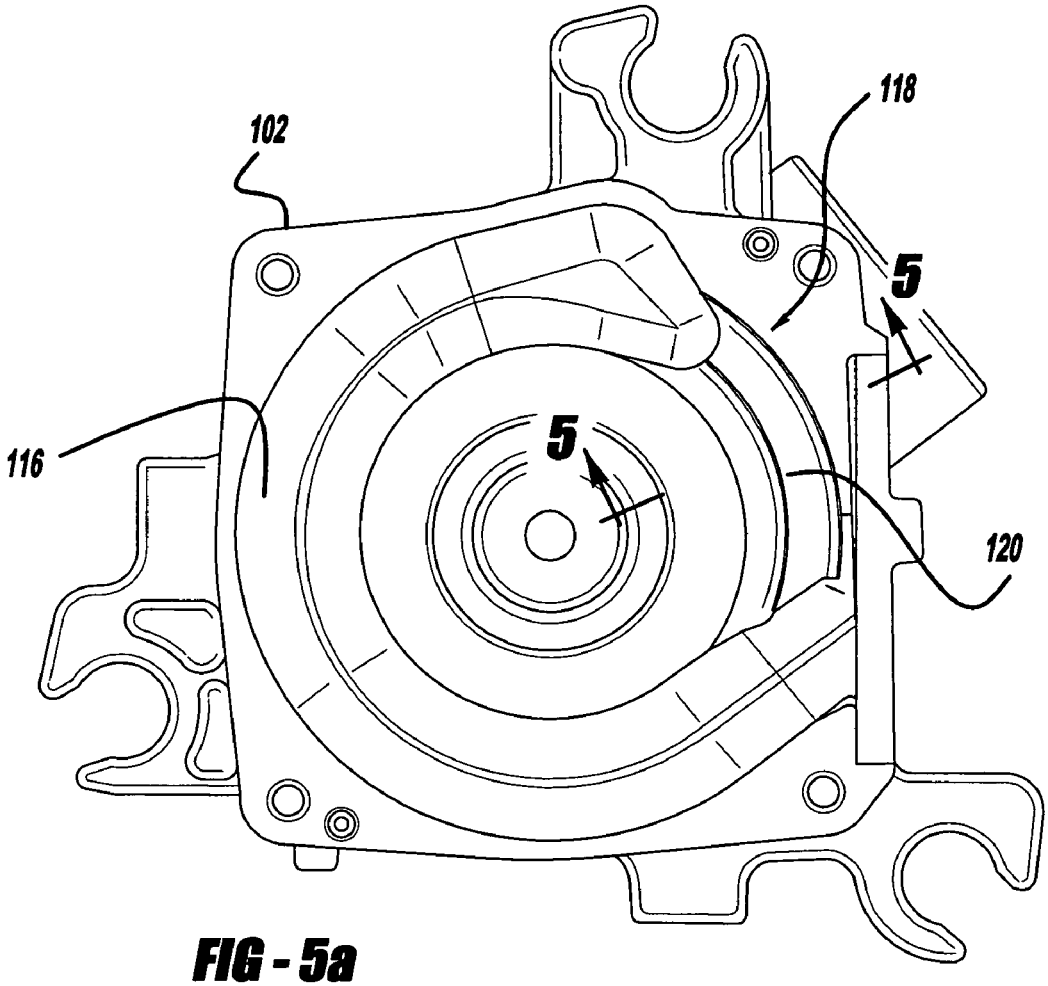
FIG. 5*a* is a sectional plan view of the pump housing having a housing groove with a tapered depth section formed thereon.
Figure 6:
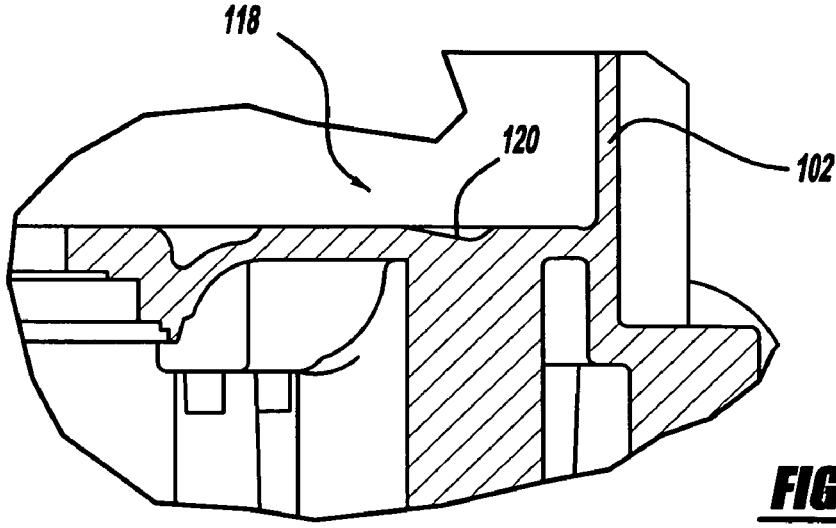
FIG. 6 is a partially broken away sectional view of the housing of FIG. 5*a*.
Figure 5B:
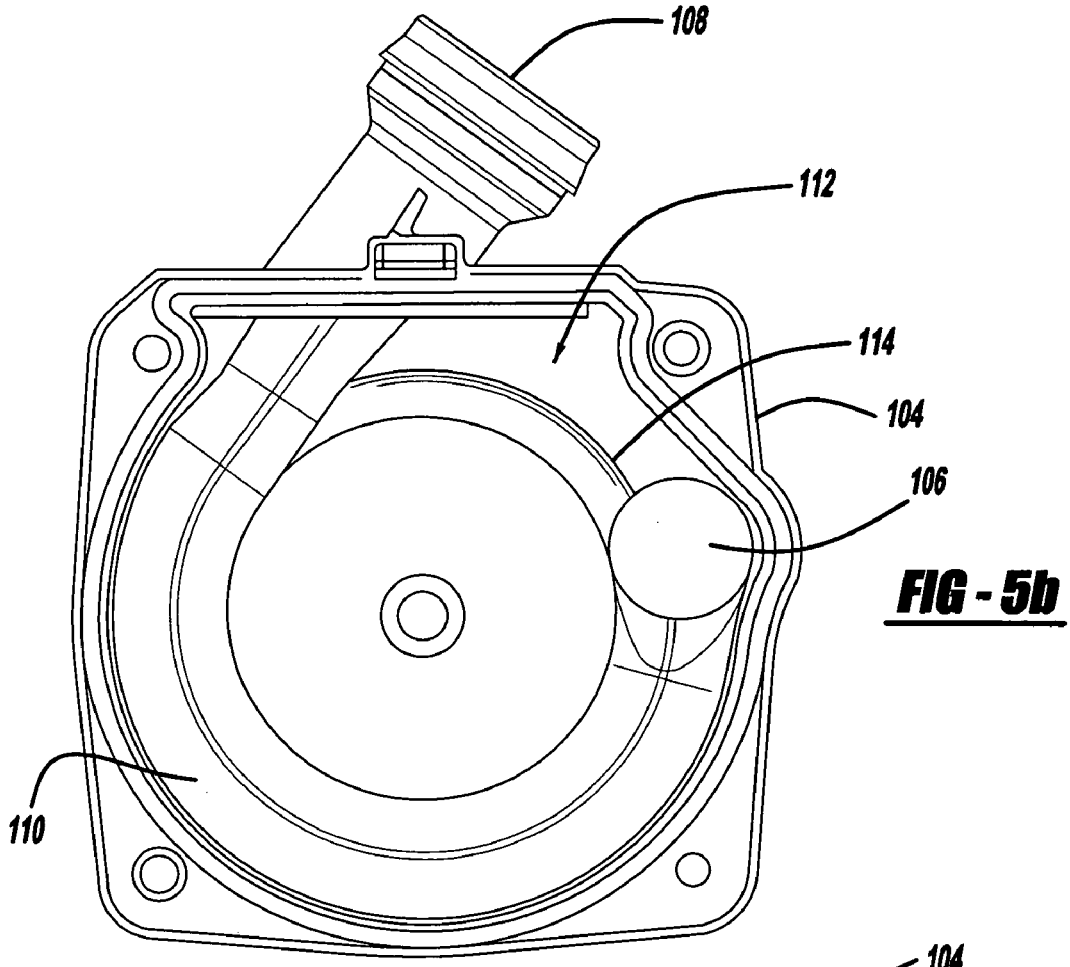
FIG. 5*b* is a sectional plan view of the pump cover having a cover groove with a tapered depth section formed thereon.
Figure 7:
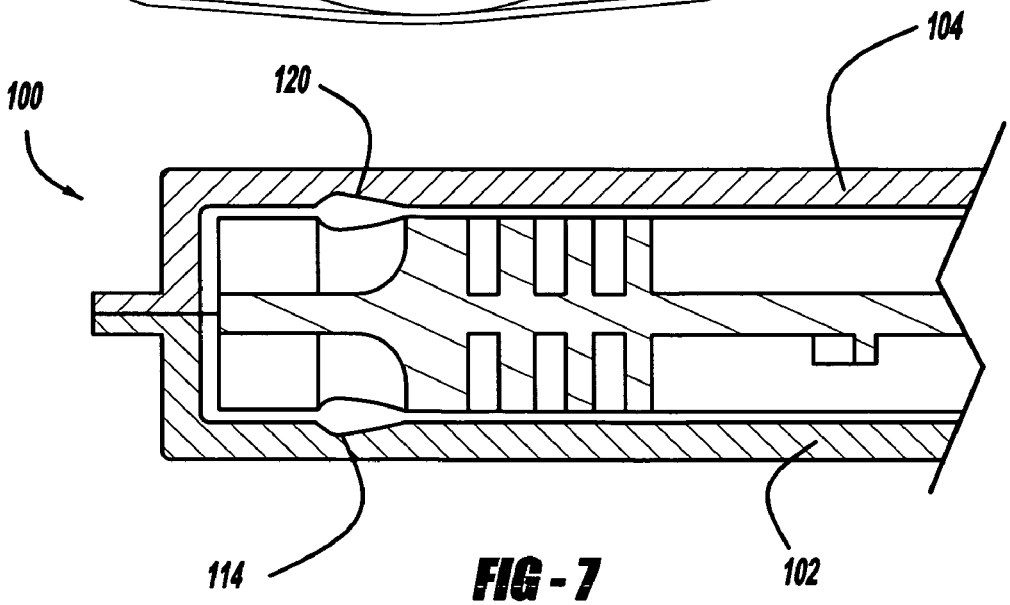
FIG. 7 is a sectional side view of the cover, housing and impeller assembly assembled.

Referring to FIGS. 5-7 an alternate embodiment of a pump 100 is depicted. The pump 100 has a housing 102 and a cover 104 is connectable to the housing 102 when the pump 100 is assembled.

The cover 104 has an inlet 106 and outlet 108. The cover has a torus 110 that defines the path of air flow between the inlet 106 and the outlet 108. A stripper region 112 of the cover 104 separates the inlet 106 and outlet 108. The stripper region 112 forms a sealing surface for sealing off flow between the inlet 106 from the outlet 108. Although this particular embodiment of the invention shows the inlet 106 and outlet 108 located on the cover 104, it is within the scope of this invention for the inlet 106 and outlet 108 to be located in the housing 102. The stripper region 112 has a cover groove 114 that provides pressure relief between the inlet 106 and outlet 108. The cover groove 114 has a surface forming a length, width and depth. The cover groove 114 can be continuous across the stripper region 112 or it can be a plurality of interrupted grooves. The length, width and depth of the cover groove can also vary.

The housing 102 has a torus 116 that aligns with the torus 110 of the cover 104 when the pump 100 is assembled. The presence of a torus on both cover 104 and housing 102 is not required by the present invention. The torus 116 on the housing 102 defines a path of air flow between the inlet 106 and outlet 108. The housing 102 also has a stripper region 118 that aligns with the stripper region 112 of the cover 104. The stripper region 118 can also form a sealing surface for sealing off flow between the inlet 106 and outlet 108. The housing groove 120 has a surface forming a length, width and depth. The housing groove 120 can be continuous across the stripper region 118 or can be a plurality of interrupted grooves. The length, width and depth of housing groove 120 can also vary. The housing groove 120 has at least one tapered depth section on said surface of said housing groove 120.

The housing groove 120 also assists in the pressure relief feature of the pump 100. However, it is not necessary that both the housing 102 and cover 104 each have grooves in order for the advantages of the present invention to be realized. It is within the scope of this invention for only one groove to be used.

Figure 8:
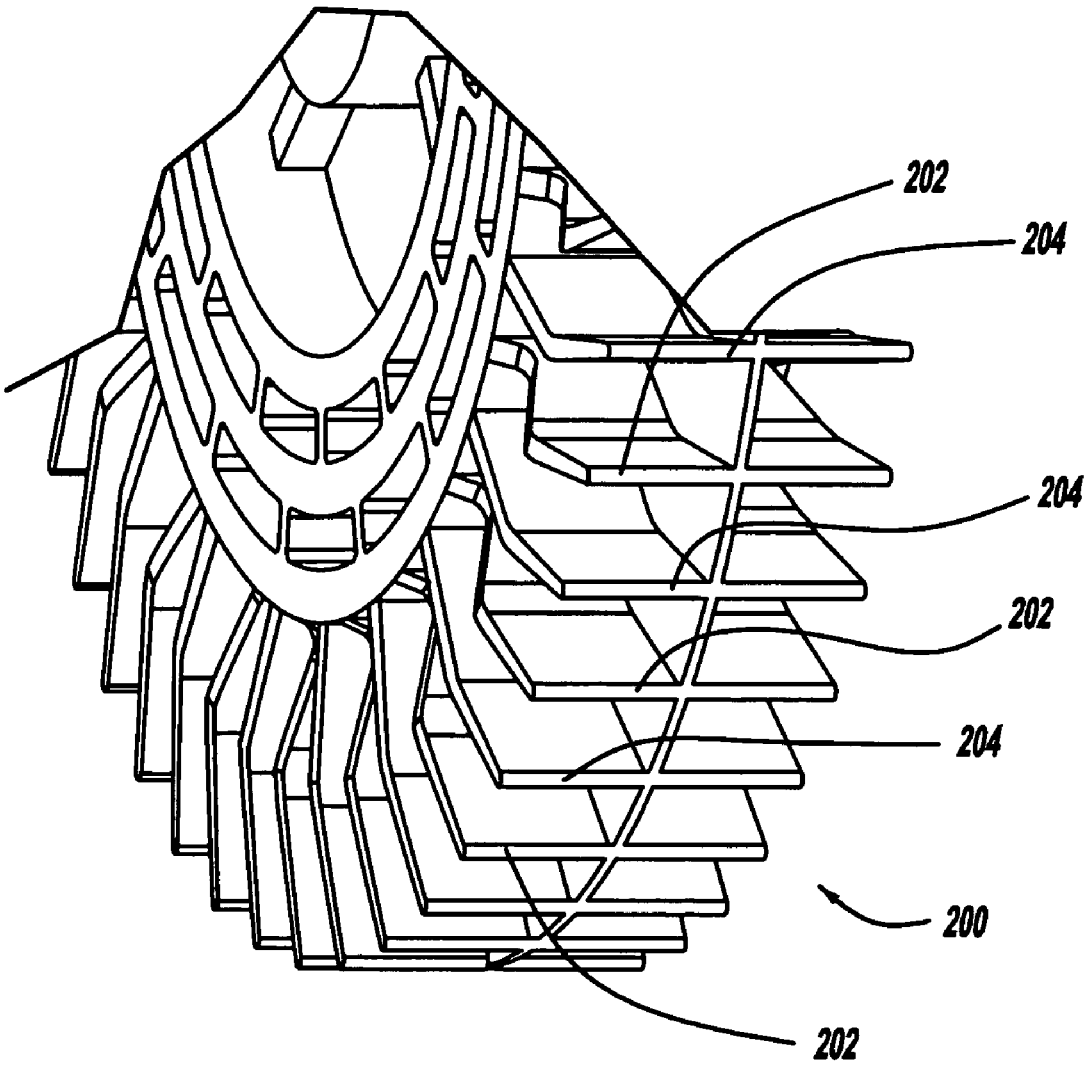
FIG. 8 is a partially broken away perspective view of an alternate embodiment of the impeller fan.

Referring to FIG. 8, another embodiment of the invention having a modified impeller fan 200 is shown. The impeller fan 200 has vanes 202 having a pressure relief feature 37 and vanes 204 having no pressure relief feature and alternating with the vanes 202. While this particular embodiment of the invention depicts the vanes 202 alternating from the vanes 204 it is within the scope of this invention for the vanes to be arranged in virtually any order. For example it is possible to have two or more vanes with pressure relief features or to have two or more vanes without pressure relief features. The arrangement of the vanes will depend on the particular need of a given application.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pump comprising:

an inlet;

an outlet;

a pumping chamber;

one or more sealing surfaces between said inlet and said outlet; and a pressure relief feature formed by at least one groove on said sealing surface, wherein said at least one groove extends across said sealing surface between said inlet and said outlet.

2. The pump of claim 1 wherein said inlet is a low pressure inlet and said outlet is a high pressure outlet.

3. The pump of claim 1 wherein said pumping chamber further comprises an impeller, a cover and housing.

4. The pump of claim 3 wherein said impeller further comprises three or more vanes and at least one vane has a pressure relief feature formed on said vane.

5. The pump of claim 4 further comprising a divider between said at least two of said three or more vanes.

6. A pump comprising:

a housing having a torus and a stripper region;

an inlet and an outlet of said pump;

a pressure relief feature formed by a housing groove formed on a surface of said stripper region of said housing, said housing groove having a surface forming a length, width and depth of said housing groove, wherein said housing groove extends across said surface between said inlet and said outlet;

a cover connectable to said housing, said cover extending over said housing groove formed on the surface of said stripper region; and an impeller having a plurality of vanes rotatably positioned between said housing and said cover and said plurality of vanes are positioned in operable relation to said housing groove.

7. The pump of claim 6 further comprising a pressure relief feature on said plurality of vanes.

8. The pump of claim 7 further comprising at least one divider extending between said vanes.

9. The pump of claim 7 wherein each of said plurality of vanes has a base and a point wherein said pressure relief feature extends between said base and said point.

10. The pump of claim 9 wherein at least one vane of said plurality of vanes has a tapered width such that the thickness of a portion along the length of said vane is greater than the thickness of a tip of said vane and of a base of said vane.

11. The pump of claim 10 wherein said at least one vane of said plurality of vanes does not have a tapered width.

12. The pump of claim 6 wherein said cover has a torus and a stripper region that aligns with said torus and said stripper region of said housing when said cover is connected to said housing.

13. A pump comprising:

a housing;

an inlet and an outlet of said pump;

a cover having a torus and a stripper region;

a pressure relief feature formed by a cover groove formed on a surface of said stripper region, said cover groove having a surface forming a length, width and depth of said cover groove, wherein said cover groove extends across said surface between said inlet and said outlet;

wherein said cover is connectable to said housing, wherein said housing extends over said cover groove formed on the surface of said stripper region; and an impeller having a plurality of vanes rotatably positioned between said housing and cover and said plurality of vanes are positioned in operable relation to said cover groove.

14. The pump of claim 13 further comprising a pressure relief feature on said plurality of vanes.

15. The pump of claim 14 further comprising at least one divider extending between said vanes.

16. The pump of claim 14 wherein each of said plurality of vanes has a base and a point wherein said pressure relief feature extends between said base and said point.

17. The pump of claim 16 wherein at least one vane of said plurality of vanes has a tapered width such that the thickness of a portion along the length of said vane is greater than the thickness of a tip of said vane and of a base of said vane.

18. The pump of claim 15 wherein said at least one vane of said plurality of vanes does not have a tapered width.

19. The pump of claim 13 wherein said cover has a torus and a stripper region that aligns with said torus and said stripper region of said housing when said cover is connected to said housing.

20. A pump comprising:

a housing;

a cover connectable to said housing;

an impeller having a plurality of vanes rotatably positioned between said housing and cover and said plurality of vanes are positioned in operable relation between said housing and said cover; and wherein at least one of said plurality of vanes has a pressure relief feature and at least one of said plurality of vanes has no pressure relief feature.

21. The pump of claim 20 further comprising at least one divider extending between said vanes.

22. The pump of claim 21 wherein said divider intersects the height of the said vanes and creates an upper flow area and a lower flow area wherein said upper flow area is formed by the operable relation between said plurality of vanes and said cover and said lower flow area is formed by the interaction of said plurality of vanes and said housing.

23. The pump of claim 20 wherein each of said plurality of vanes has a base and a point and said pressure relief feature extends between said base and said point.

24. The pump of claim 23 wherein at least one vane of said plurality of vanes has a tapered width such that the thickness of a portion along the length of said vane is greater than the thickness of a tip of said vane and of said base of said vane.

25. The pump of claim 20 further comprising:

a torus and a stripper region on said housing;

a housing groove formed on a surface of said stripper region of said housing, said housing groove having a surface forming a length, width and depth of said housing groove;

a torus and a stripper region on said cover; and a cover groove formed on a surface of said stripper region, said cover groove having a surface forming a length, width and depth of said cover groove.

26. The pump of claim 25 wherein said torus and said stripper region of said cover aligns with said torus and said stripper region of said housing when said cover is connected to said housing, wherein said impeller is rotatably positioned between said cover and said housing.

* * * * *